US009561153B2

(12) United States Patent
Nygard et al.

(10) Patent No.: US 9,561,153 B2
(45) Date of Patent: Feb. 7, 2017

(54) SPA LEDGE WITH SPILL SILL

(71) Applicant: MAAX Spas Industries Corporation, Chandler, AZ (US)

(72) Inventors: Emil Nygard, Chandler, AZ (US); Robert Lange, Mesa, AZ (US)

(73) Assignee: MAAX Spas Industries Corporation, Chandler, AZ (US)

( * ) Notice: Subject to any disclaimer, the term of this patent is extended or adjusted under 35 U.S.C. 154(b) by 556 days.

(21) Appl. No.: 14/062,575

(22) Filed: Oct. 24, 2013

(65) Prior Publication Data

US 2014/0109308 A1 Apr. 24, 2014

Related U.S. Application Data

(60) Provisional application No. 61/718,055, filed on Oct. 24, 2012.

(51) Int. Cl.

| | |
|---|---|
| ***A61H 33/00*** | (2006.01) |
| ***E04H 4/12*** | (2006.01) |
| *A61H 33/02* | (2006.01) |

(52) U.S. Cl.

CPC ..... *A61H 33/6068* (2013.01); *E04H 4/1218* (2013.01); *A61H 33/0087* (2013.01); *A61H 33/02* (2013.01)

(58) Field of Classification Search

CPC A61H 33/02; A61H 33/0087; A61H 33/6068; A61H 33/6073; E04H 4/1218

USPC ..... 4/510, 512, 584

See application file for complete search history.

(56) References Cited

U.S. PATENT DOCUMENTS

| | | | | | |
|---|---|---|---|---|---|
| 2,439,866 | A * | 4/1948 | Saladin | E04H 4/1218 | 210/167.12 |
| 2,529,568 | A * | 11/1950 | O'Hara | A47K 3/02 | 4/584 |
| 3,585,656 | A * | 6/1971 | Costello | E04H 4/141 | 4/494 |
| 4,050,104 | A * | 9/1977 | Baker | E04H 4/1227 | 4/510 |
| 4,383,340 | A * | 5/1983 | Braun, Jr. | A61H 33/0087 | 4/541.1 |
| 4,462,125 | A * | 7/1984 | Jakowicki | E04H 4/00 | 4/506 |

* cited by examiner

*Primary Examiner* — J. Casimer Jacyna
(74) *Attorney, Agent, or Firm* — JoAnn M. Seaton; Griffiths & Seaton PLLC

(57) ABSTRACT

A ledge that incorporates a spill sill as a portion of the ledge is disclosed. The ledge includes one or more ports and the spill sill is shaped in a manner that catches liquid as it overflows and directs the water to the port(s). The port(s) are utilized to drain the liquid from the ledge so that the liquid can be routed away for disposal. In addition to being functional, the ledge includes dimensions and/or configurations that make the ledge aesthetically pleasing.

19 Claims, 7 Drawing Sheets

SPA LEDGE WITH SPILL SILL

BACKGROUND OF THE INVENTION

Field of the Invention

The present invention relates generally to ledges for directing the flow of liquid, and more particularly, to spa ledges with spill sill for directing the flow of the liquid and supplying aesthetic appeal.

Description of the Related Art

Water often overflows from a spa when the spa is in use. As such, some spas include a means for catching the overflowing water and routing the water back to the spa for re-use. Though re-using the overflowed water is an efficient use of water, water recycled in this manner is not as hygienic as replenishing the spa with new water to replace the overflowed water. Furthermore, the design for the means for routing the overflow water for re-use is directed more toward functionality, and not toward attractiveness. Therefore, there is a need for a spa ledge with a spill sill that functions to route overflowing water away from the spa, as well as, is appealing to the eye from an aesthetic perspective.

SUMMARY OF THE INVENTION

Various embodiments provide a spa ledge that incorporates a spill sill as a portion of the spa ledge. The spa ledge comprises one or more ports and the spill sill is shaped in a manner that catches water as it overflows from a spa and directs the water to the port(s). The port(s) are utilized to drain the water from the ledge so that the water can be routed away from the spa for disposal.

In one embodiment, the spill sill forms two ridges including different heights in which the ridge with the greatest height is located proximate to the interior or tub of the spa, while the smaller ridge is located proximate to the exterior of the spa or away from the tub. The two ridges include a height ratio that enables the overflowing water to be effectively caught and directed to the port(s), while also including a contrast that is visually appealing.

The spa ledge, in an embodiment, includes a port located at a lowest point in the lateral center of the ledge and the spill sill includes two portions that slope downward from an upper portion of the lateral ends of the spa ledge to the port in a manner the directs water to the center of the spa ledge where the port is located. In another embodiment, the spa ledge includes a port located at a lowest point on the lateral edge of the ledge and the spill sill includes two portions that slope downward from an upper portion of the lateral center of the spa ledge to the ports in a manner the directs water to the edges of the spa ledge where the ports are located.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

The illustrated embodiments below provide spas comprising a spa ledge with a spill sill. The spa ledge functions to direct water away from the spa, while also providing an aesthetically pleasing appearance.

Figure 1:
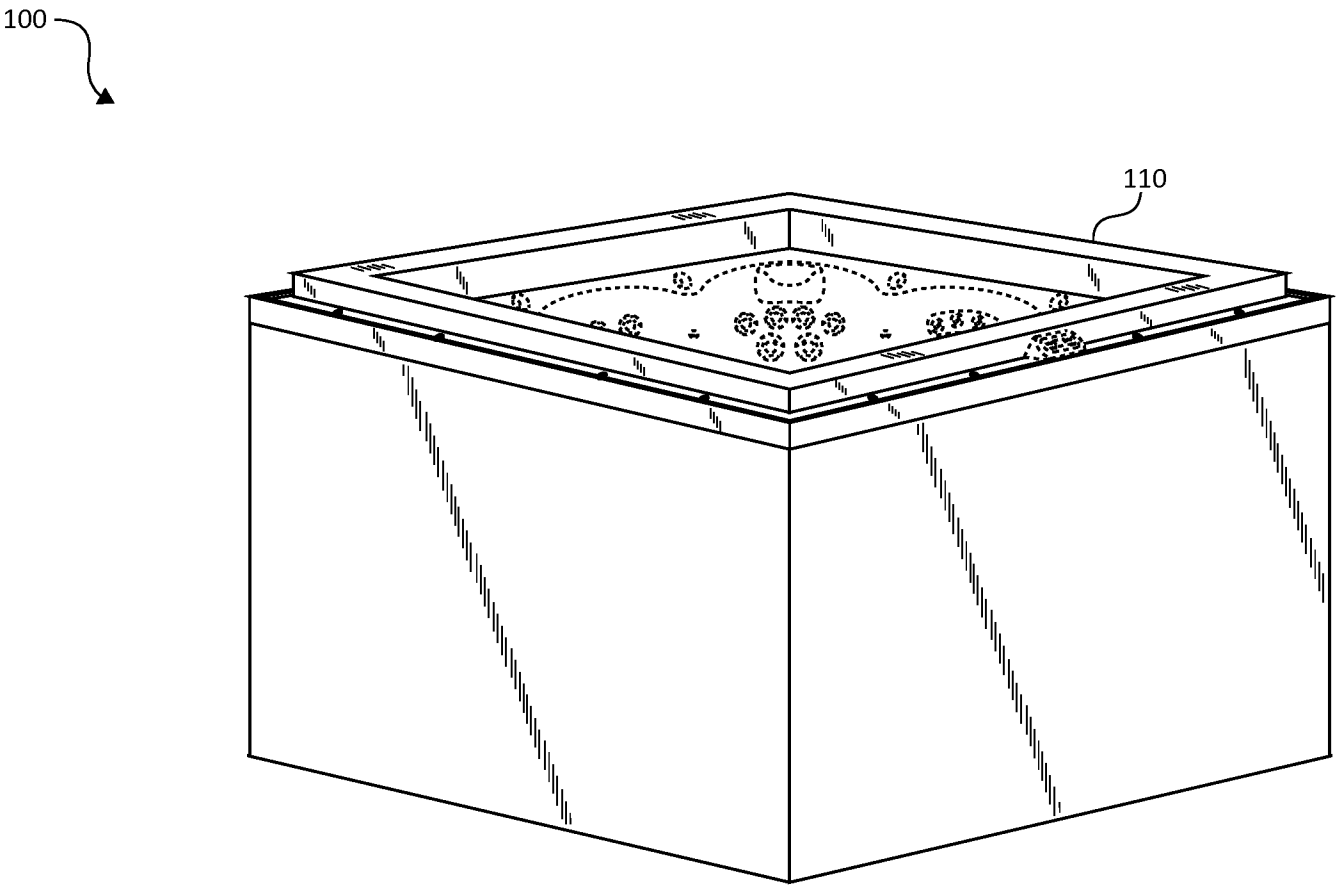
FIG. 1 is a diagram of one embodiment of a spa comprising a spa ledge.

Turning now to the figures, FIG. 1 illustrates a spa 100 comprising one embodiment of a spa ledge 110. Spa ledge 110 may comprise any material known in the art or developed in the future capable of catching and directing overflow water. That is, spa ledge 110 may be formed of any material suitable for a spa ledge. Examples of suitable materials include, but are not limited to, polymers, plastics, natural materials (e.g., stone), and the like materials.

Notably, although spa ledge 110 is illustrated in the various embodiments presented herein as a quadrilateral, spa ledge 110 is not limited to the shape illustrated herein. That is, spa ledge 110 may comprise any desired shape and/or any desired dimensions depending on the application of spa ledge 110.

Figure 2:
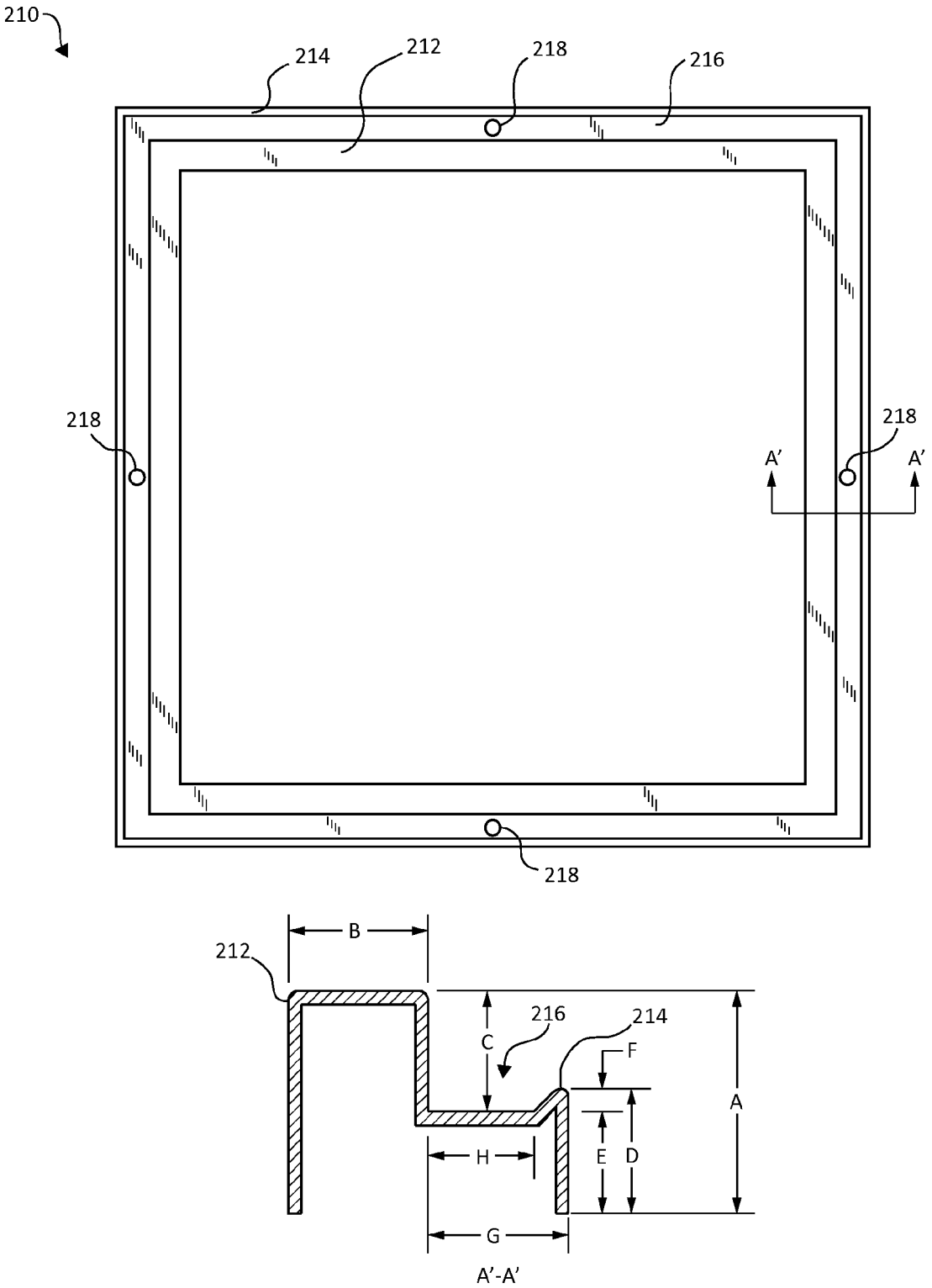
FIG. 2 is a top view of the spa ledge illustrated in FIG. 1 comprising one embodiment of a spill sill.
Figure 3:
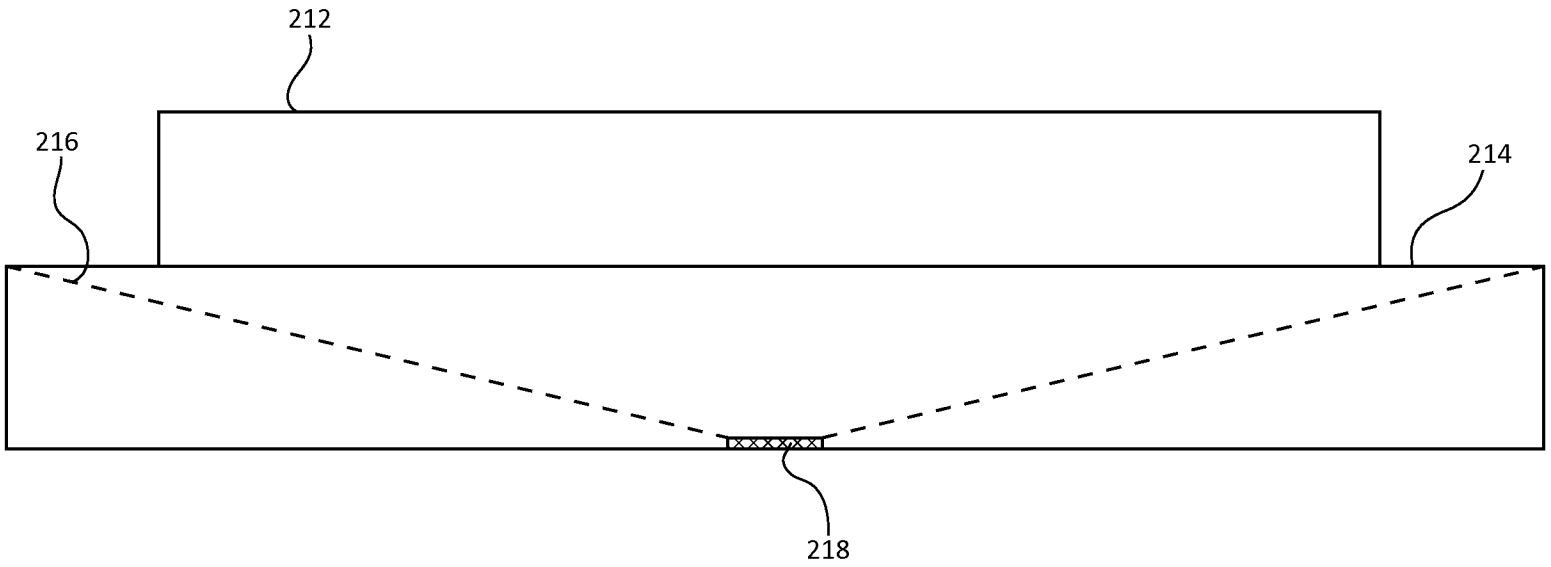
FIG. 3 is a perspective view of the spa ledge illustrated in FIG. 2.
Figure 4:
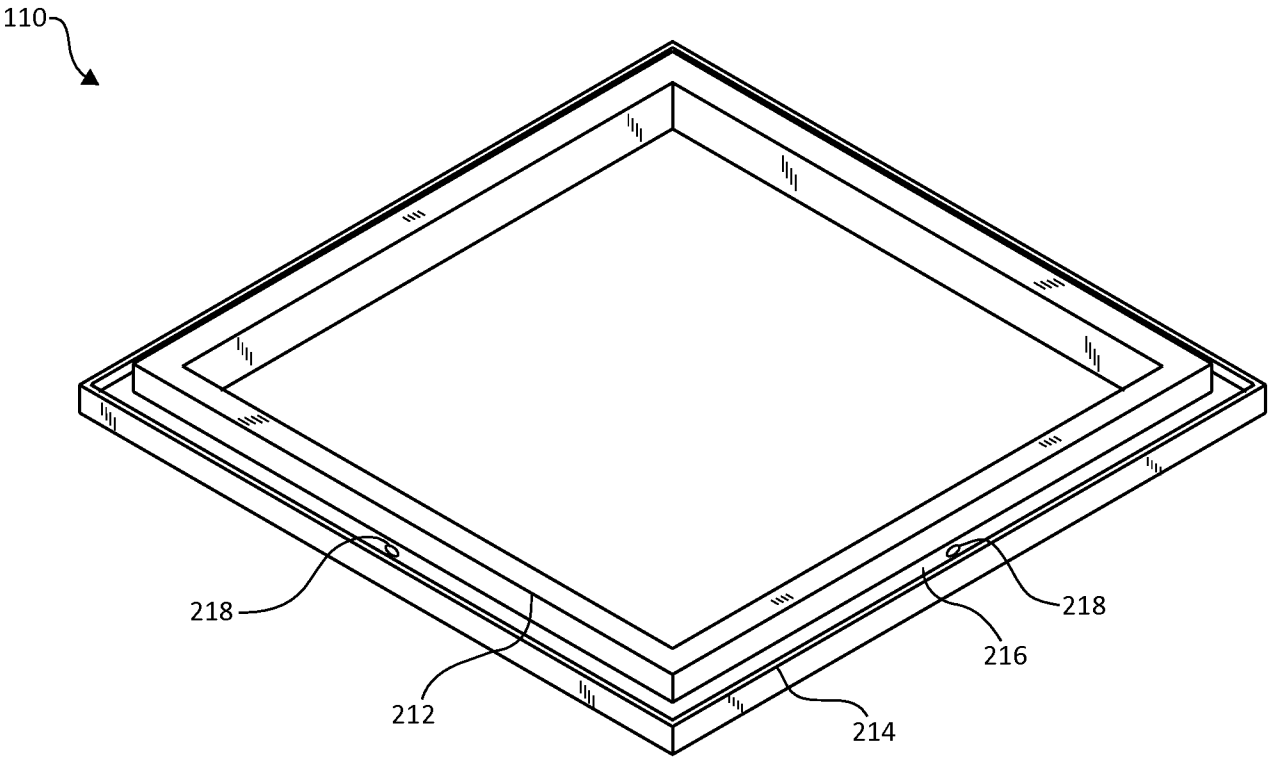
FIG. 4 is a diagram of the spill sill illustrated in FIG. 2.

With reference to FIG. 2, FIG. 2 is a diagram of one embodiment of spa ledge 110, which is referred to as spa ledge 210 in FIGS. 2-4. Spa ledge 210, at least in the illustrated embodiment, comprises a ridge 212 and a ridge 214 that form a spill sill 216 comprising a plurality of ports 218 (e.g., drains).

Ridge 212, as illustrated in cut out A'-A', comprises a total height A, a width B, and a secondary height C that forms a portion of spill sill 216. Height A may be any desired height depending on the application of spa ledge 210. In various embodiments, Height A is in the range of about 1 inch to about 12 inches. In the illustrated embodiment, Height A is about 6.4 inches.

Width B, in various embodiments, is on the range of about 0.5 inches to about 6 inches. In the illustrated embodiment, width B is about 4 inches.

In various embodiments, height C is in the range of about 0.5 inches to about 11 inches. In the illustrated embodiment, height C is about 3.5 inches.

With reference now to ridge 214, ridge 214, as illustrated in cut out A'-A', comprises a total height D and a secondary height E forming a differential height F that forms a portion of spill sill 216. In various embodiments, height D is in the range of about 0.5 inches to about 11.5 inches. In the illustrated embodiment, height D is about 3.5 inches.

Height E, in various embodiments, is in the range of about 0.25 inches to about 11 inches. In the illustrated embodiment, height E is about 3.6 inches.

The above dimensions of height D and height E result in height F being in the range of about 0.25 inches to about 1 inch. In the illustrated embodiment, height F is about 0.6 inches.

Referring now to spill sill 216, spill sill 216, as illustrated in cut out A'-A', comprises a total width G and a secondary width H forming a differential width I that forms a width of ridge 214. In various embodiments, width G is in the range of about 1 inch to about 8 inches. In the illustrated embodiment, width G is about 4 inches.

Width H, in various embodiments, is in the range of about 0.75 inches to about 7.75 inches. In the illustrated embodiment, width H is about 3 inches.

The above dimensions of width G and width H result in width I being in the range of about 0.25 inches to about 2 inches. In the illustrated embodiment, width I is about 1 inch.

As discussed above, spill sill 216 comprises a plurality of ports 218 configured to route water away from spa 100. In the embodiment illustrated in FIG. 2, each side of spa ledge 210 comprises a port 218 located in the center of each side.

Spill sill 216 includes one or more slopes that assist in directing overflow water to each port 218. As shown in FIG. 3, spill sill 216 comprises two slopes angled from the two outer lateral edges of spa ledge 210 toward the lateral center of spa ledge 210 where port 218 is located. Each slope may include any gradient that functions to direct water to port 218. In various embodiments, the gradient is in the range of about 1% to about 10%. In the illustrated embodiment, the gradient is 5%.

While spill sill 216 is illustrated as being formed by right angles or including a squared shape, spill sill 216 is not limited to this configuration. That is, spill sill 216 may include any desired shape depending on the application of spa ledge 210.

Various embodiments provide a spa ledge that incorporates a spill sill as a portion of the spa ledge. The spa ledge comprises one or more ports and the spill sill is shaped in a manner that catches water as it overflows from a spa and directs the water to the port(s). The port(s) are utilized to drain the water from the ledge so that the water can be routed away from the spa for disposal.

With reference now to FIG. 4, FIG. 4 is a perspective view of the embodiment of spa ledge 210 illustrated in FIG. 2. As shown in FIG. 4, the dimensions of ridge 212 and ridge 214 not only function to create spill sill 216, but also create a geometric shape that is aesthetically pleasing. Specifically, when viewed from a 90-degree angle with respect to the exterior wall of ridge 212 and ridge 214, water flowing over ridge 212 appears as a waterfall that "disappears" since spill sill 216 is obstructed by ridge 214.

Furthermore, the aesthetics of spa ledge 210 are more appealing because ridge 212 and ridge 214 comprise a stepped look, which is visually appealing and also blocks spill sill 216 from being visible from this angle. The stepped look is created by the differential between height A and height C plus height F (i.e., height A−(height C+height F)). In various embodiments, the height ratio of this differential in the range of about 1.5:1 to about 5:1. In the illustrated embodiment, the differential is about 2.1:1.

Figure 5:
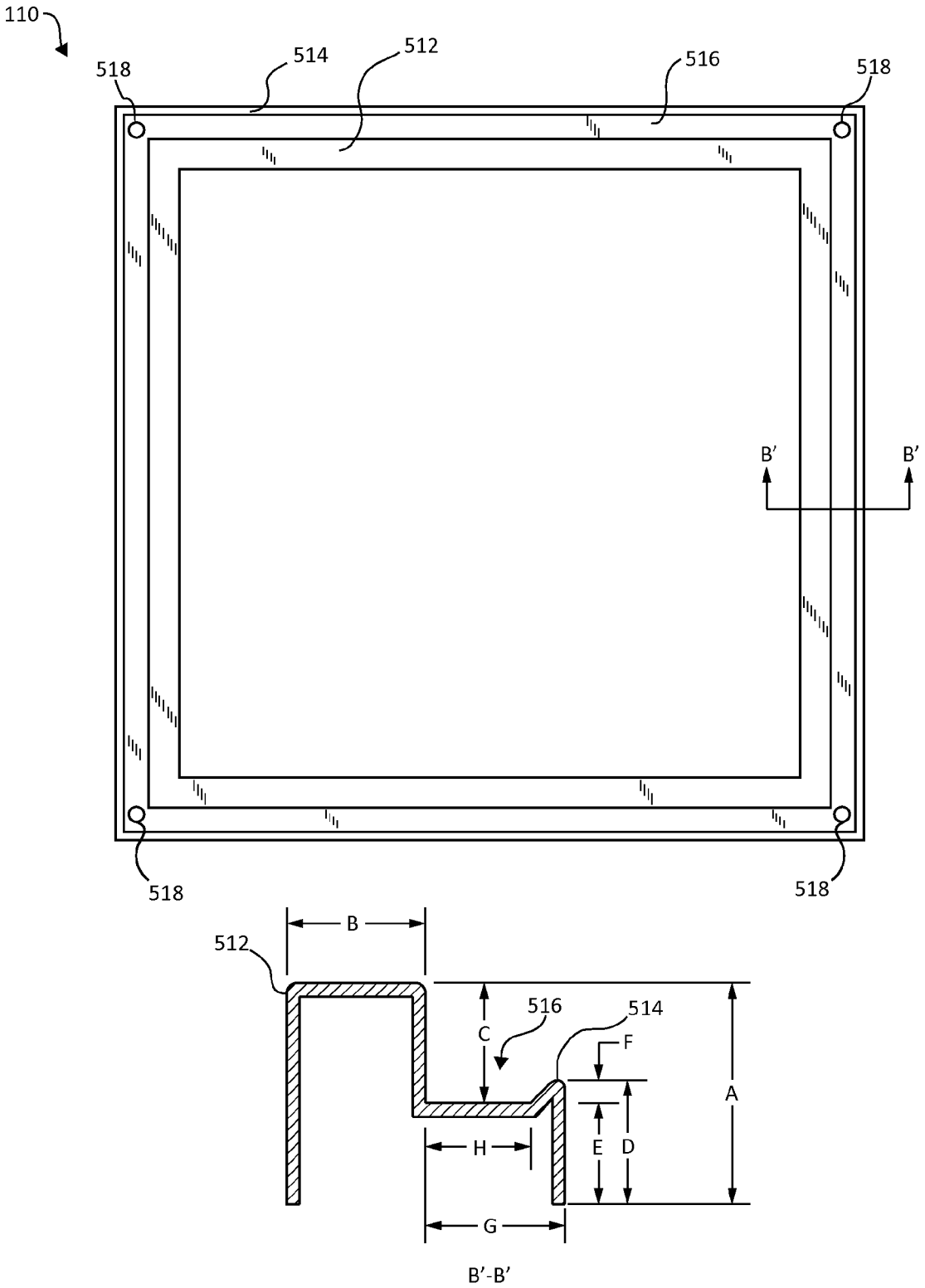
FIG. 5 is a top view of the spa ledge illustrated in FIG. 1 comprising another embodiment of a spill sill.

With reference to FIG. 5, FIG. 5 is a diagram of another embodiment of spa ledge 510, here referred to as spa ledge 510. Spa ledge 510, at least in the illustrated embodiment, comprises a ridge 512 and a ridge 514 that form a spill sill 516 comprising a plurality of ports 518 (e.g., drains).

Ridge 512, as illustrated in cut out B'-B', comprises a total height A, a width B, and a secondary height C that forms a portion of spill sill 516. Height A may be any desired height depending on the application of spa ledge 510. In various embodiments, Height A is in the range of about 1 inch to about 12 inches. In the illustrated embodiment, Height A is about 6.4 inches.

Width B, in various embodiments, is on the range of about 0.5 inches to about 6 inches. In the illustrated embodiment, width B is about 4 inches.

In various embodiments, height C is in the range of about 0.5 inches to about 11 inches. In the illustrated embodiment, height C is about 3.5 inches.

With reference now to ridge 514, ridge 514, as illustrated in cut out B'-B', comprises a total height D and a secondary height E forming a differential height F that forms a portion of spill sill 516. In various embodiments, height D is in the range of about 0.5 inches to about 11.5 inches. In the illustrated embodiment, height D is about 3.5 inches.

Height E, in various embodiments, is in the range of about 0.25 inches to about 11 inches. In the illustrated embodiment, height E is about 3.6 inches.

The above dimensions of height D and height E result in height F being in the range of about 0.25 inches to about 1 inch. In the illustrated embodiment, height F is about 0.6 inches.

Referring now to spill sill 516, spill sill 516, as illustrated in cut out B'-B', comprises a total width G and a secondary width H forming a differential width I that forms a width of ridge 514. In various embodiments, width G is in the range of about 1 inch to about 8 inches. In the illustrated embodiment, width G is about 4 inches.

Width H, in various embodiments, is in the range of about 0.75 inches to about 7.75 inches. In the illustrated embodiment, width H is about 3 inches.

The above dimensions of width G and width H result in width I being in the range of about 0.25 inches to about 2 inches. In the illustrated embodiment, width I is about 1 inch.

As discussed above, spill sill 516 comprises a plurality of ports 518 configured to route water away from spa 100. In the embodiment illustrated in FIG. 5, each side of spa ledge 510 comprises ports 518 located at the edges of each side (i.e., at the corners of spa 100).

Figure 6:
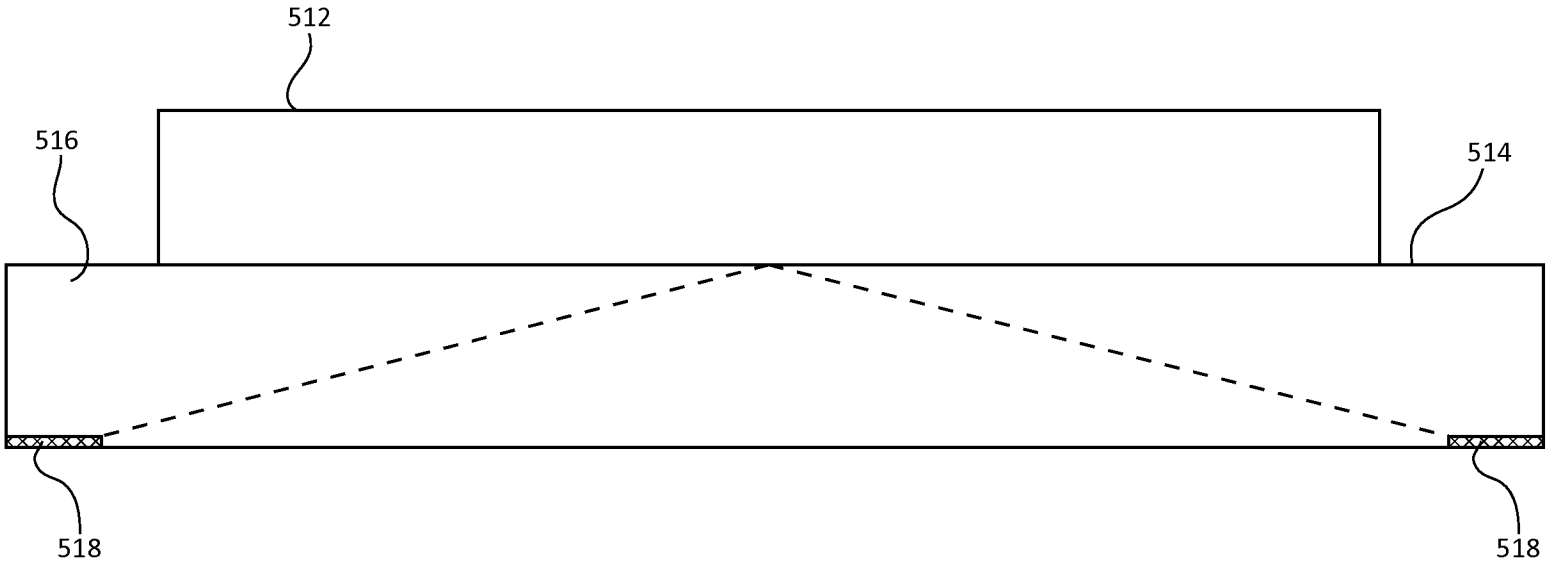
FIG. 6 is a perspective view of the spa ledge illustrated in FIG. 5.

Spill sill 516 includes one or more slopes that assist in directing overflow water to each port 518. As shown in FIG. 6, spill sill 516 comprises two slopes angled from the lateral center of spa ledge 510 toward the two lateral edges of spa ledge 510 (i.e., the corners of spa 100) where ports 518 are located. Each slope may include any gradient that functions to direct water to ports 518. In various embodiments, the gradient is in the range of about 1% to about 10%. In the illustrated embodiment, the gradient is 5%.

While spill sill 516 is illustrated as being formed by right angles or including a squared shape, spill sill 516 is not limited to this configuration. That is, spill sill 516 may include any desired shape depending on the application of spa ledge 510.

Figure 7:
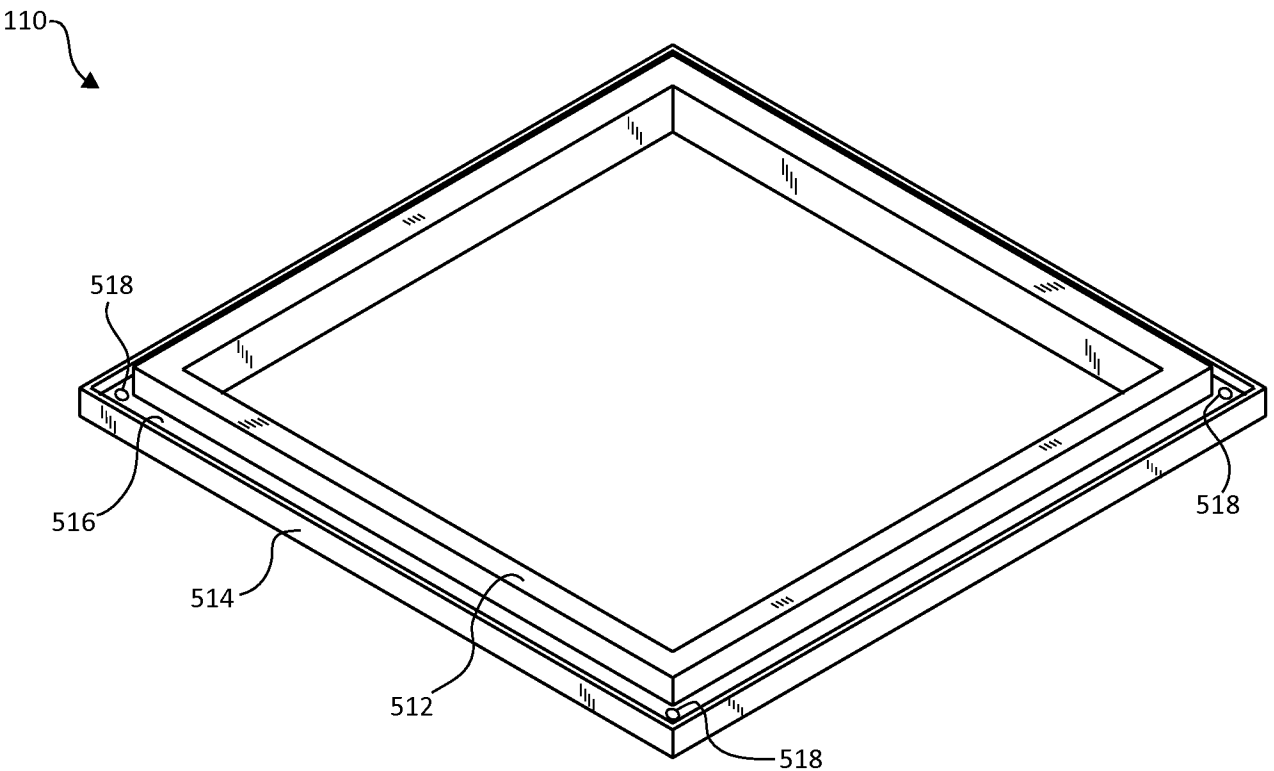
FIG. 7 is a diagram of the spill sill illustrated in FIG. 5.

With reference now to FIG. 7, FIG. 7 is a perspective view of the embodiment of spa ledge 510 illustrated in FIG. 5. As shown in FIG. 7, the dimensions of ridge 512 and ridge 514 not only function to create spill sill 516, but also create a geometric shape that is aesthetically pleasing. Specifically, when viewed from a 90-degree angle with respect to the exterior wall of ridge 512 and ridge 514, water flowing over ridge 512 appears as a waterfall that "disappears" since spill sill 516 is obstructed by ridge 514.

Furthermore, the aesthetics of spa ledge 510 are more appealing because ridge 512 and ridge 514 comprise a stepped look, which is visually appealing and also blocks spill sill 516 from being visible from this angle. The stepped look is created by the differential between height A and height C plus height F (i.e., height A−(height C+height F)). In various embodiments, the height ratio of this differential in the range of about 1.5:1 to about 5:1. In the illustrated embodiment, the differential is about 2.1:1.

Although the various embodiments have been discussed with reference to spas, the various embodiments are not limited to spas. That is, various other embodiments include water holding vessels (e.g., pools, ponds, fountains, hot tubs, etc., and/or the like water features) with ledges with spill sills similar to the embodiments described above.

The invention claimed is:

1. A spa, comprising:

a tub; and a ledge surrounding at least a portion of the tub, wherein the ledge comprises:

a first ridge adjacent to and forming a portion of at least one sidewall of the tub, the first ridge defining a first ridge top surface, a first port configured for routing water away from the tub, and a spill sill located adjacent and on a side of the first ridge opposite the tub and in fluid communication with the first port, which extends through the spill sill, wherein:

the spill sill defines a sill length extending parallel with the portion of the at least one sidewall and including a sill top surface configured for catching water as the water overflows from the tub over the first ridge, and the sill top surface is downwardly angled along the sill length such that the sill top surface is positioned farther away from the first ridge top surface adjacent the first port as compared to other portions of the sill top surface to direct the water to the first port.

2. The spa of claim 1, wherein the edge comprises a second ridge, wherein the first ridge, having a greater height compared to the smaller second ridge, is located proximate to the tub and a smaller second ridge is located away from the tub, and the spill sill is defined between the first ridge and the smaller second ridge.

3. The spa of claim 2, wherein the first ridge and the smaller second ridge include a height ratio, representing the greater height of the first ridge relative to a height of the smaller second ridge, that enables overflowing water to be caught and directed to the first port and also includes a contrast that visually makes the overflowing water disappear.

4. The spa of claim 3, wherein the height ratio is in the range of about 1.5:1 to about 5:1.

5. The spa of claim 1, wherein the first port is located at a lowest point in a lateral center of the ledge, and the spill sill includes two portions that each slope downwardly from an upper portion of lateral ends of the ledge to the first port in a manner that directs water to the lateral center of the ledge where the first port is located.

6. The spa of claim 5, wherein the edge comprises a smaller second ridge, wherein the first ridge, having a greater height than the smaller second ridge, is located proximate to the tub and a smaller second ridge is located away from the tub.

7. The spa of claim 6, wherein the first ridge and the smaller second ridge include a height ratio, representing the greater height of the first ridge relative to a height of the smaller second ridge, that enables overflowing water to be caught and directed to the first port and also includes a contrast that visually makes the overflowing water disappear.

8. The spa of claim 1, wherein the ledge is formed as a single piece.

9. The spa of claim 1, wherein:

the ledge has a ledge length extending along an of the at least one sidewall of the tub, and the sill length extends along an entirety of the ledge length.

10. The spa of claim 1, wherein the ledge surrounds an entire perimeter of the tub, and the spill sill continuously extends around the tub.

11. The spa of claim 10, wherein:

a top view of the tub is quadrilaterally shaped, a top view of the spill sill is quadrilaterally shaped around the tub such that the spill sill defines four lateral lengths, the spa further comprises at least a second port, a third port, and a fourth port, and each of the first port, the second port, the third port, and the fourth port extend through a different one of the four lateral lengths of the spill sill.

12. The spa of claim 1, wherein:

the first ridge top surface has a width, and a height measured between the sill top surface and the first ridge top surface is less than the width of the first ridge top surface.

13. The spa of claim 12, wherein the spill sill has a sill width that is less than the width of the first ridge top surface.

14. The spa of claim 1, wherein:

the sill top surface includes a first angled portion and a second angled portion, the first angled portion of the sill top surface extends upwardly away from a first side of the first port along a first portion of the sill length, the second angled portion of the sill top surface extends upwardly away from a second side of the first port along a second portion of the sill length, and the second side of the first port is opposite the first side of the first port.

15. The spa of claim 1, wherein the spill sill is downwardly angled at a gradient in the range of about 1% to about 10%.

16. The spa of claim 1, wherein the gradient is about 5%.

17. The spa of claim 1, wherein the ledge includes a second ridge extending along the sill length adjacent to the spill sill opposite the first ridge to block water from exiting over an edge of the spill sill opposite the tub.

18. The spa of claim 17, wherein the second ridge is positioned below the first ridge top surface such that the second ridge is generally not visible by a user while the user is sitting in the tub.

19. The spa of claim 18, wherein the second ridge extends above the spill sill a distance in the range of about 0.25 inch to about 1 inch.

* * * * *